US005369338A

United States Patent [19]

Kim

[11] Patent Number: 5,369,338

[45] Date of Patent: Nov. 29, 1994

[54] STRUCTURE OF A PLASMA DISPLAY PANEL AND A DRIVING METHOD THEREOF

[75] Inventor: Dae-il Kim, Suwon, Rep. of Korea

[73] Assignee: Samsung Electron Devices Co., Ltd., Kyungki-do, Rep. of Korea

[21] Appl. No.: 970,036

[22] Filed: Nov. 2, 1992

[30] Foreign Application Priority Data

Mar. 26, 1992 [KR] Rep. of Korea ..... 92-4969

[51] Int. Cl.[5] ..... G09G 3/10

[52] U.S. Cl. ..... 315/169.4; 315/169.1; 315/169.3; 313/584; 313/585; 313/586; 313/587

[58] Field of Search ..... 313/584, 585, 586, 587; 315/58, 71, 169.1, 169.3, 169.4, 167

[56] References Cited

U.S. PATENT DOCUMENTS

| | | | |
|---|---|---|---|
| 4,728,864 | 3/1988 | Dick | 313/585 |
| 4,866,349 | 9/1989 | Weber et al. | 315/169.3 |
| 4,914,352 | 4/1990 | Gay et al. | 315/169.4 |
| 4,924,218 | 5/1990 | Weber et al. | 315/169.4 |
| 4,996,460 | 8/1990 | Kim et al. | 313/586 |
| 4,999,541 | 8/1990 | Kim et al. | 313/584 |
| 5,081,400 | 1/1992 | Weber et al. | 315/169.3 |
| 5,138,225 | 5/1991 | Kim | 313/584 |
| 5,144,200 | 5/1991 | Kim | 313/584 |

*Primary Examiner*—William L. Sikes
*Assistant Examiner*—Jim Dudek
*Attorney, Agent, or Firm*—Leydig, Voit & Mayer

[57] ABSTRACT

A plasma display panel (PDP) is disclosed which includes a plurality of anodes formed on an upper plate, a plurality of first sustaining electrodes and a plurality of alternating second sustaining electrodes and cathodes formed on a lower plate, and a dielectric coated on the first and second sustaining electrodes and cathodes. A method for driving the PDP includes the steps of initiating a discharge by supplying a potential higher than the discharge firing voltage to the anodes and cathodes, generating a predetermined potential between the cathodes and first sustaining electrodes to increase the voltage generated from the discharge-initiating step, supplying a voltage higher than a discharge sustaining voltage between the first and second sustaining electrodes to maintain the discharge, and supplying a narrow pulse to the cathodes for erasing the discharge.

13 Claims, 6 Drawing Sheets

FIG. 3B
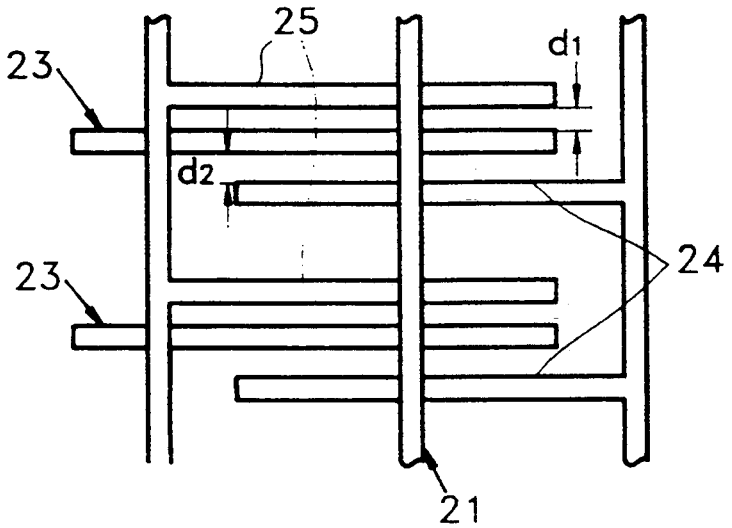
FIG. 4A
FIG. 4B
FIG. 4C
FIG. 4D
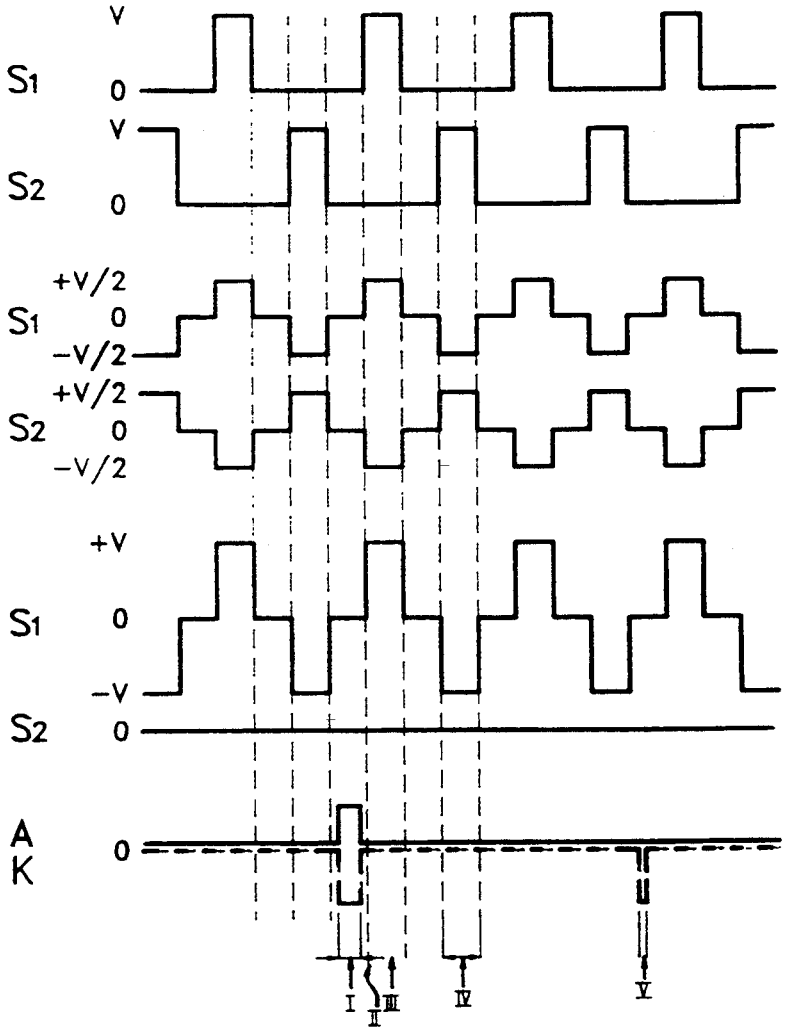

FIG. 5A
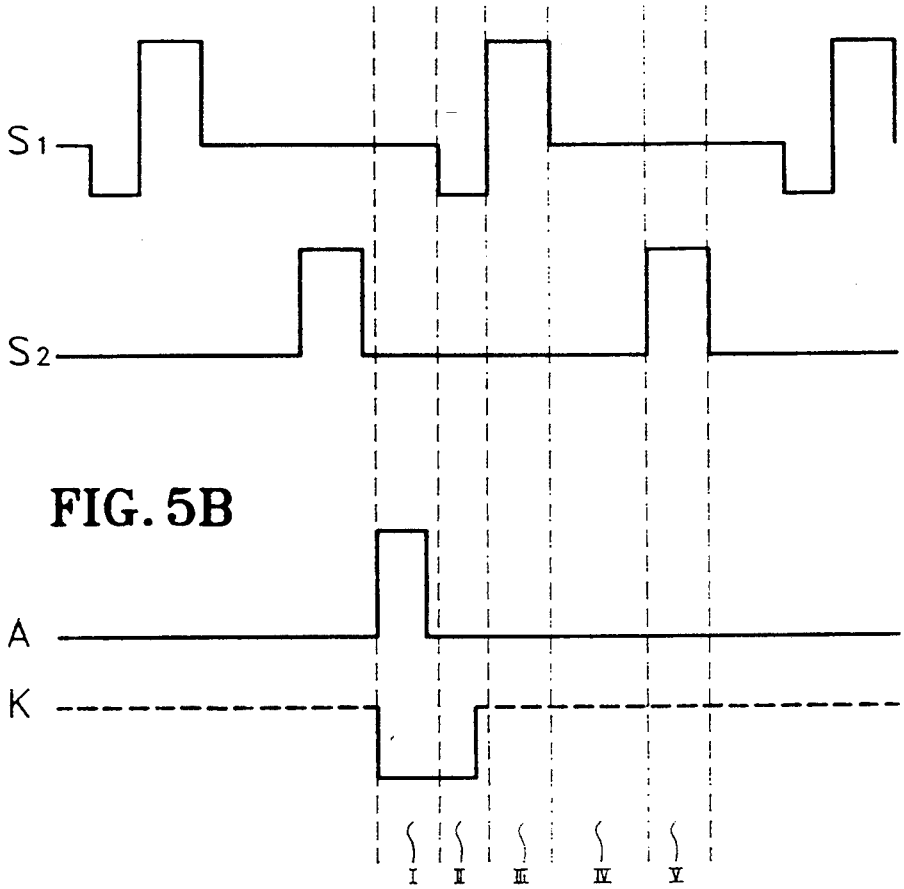
FIG. 5B
FIG. 5C
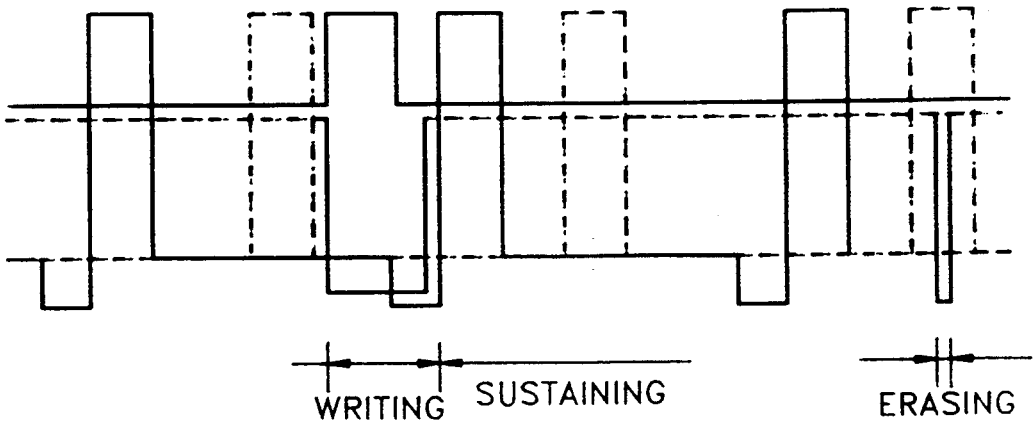

STRUCTURE OF A PLASMA DISPLAY PANEL AND A DRIVING METHOD THEREOF

BACKGROUND OF THE INVENTION

The present invention relates to a plasma display panel (PDP), and more particularly to a structure of a PDP and a driving method thereof.

In order to realize wall-mounted, flat televisions using PDPs, a luminance level equivalent to that of a standard CRT should be achieved. For this, the current AC- and DC-type PDPs have to adopt a memory type display.

The DC type memory has been long studied by the NHK Broadcasting Committee, so that such a display now has a 40-inch clear picture. However, since the memory type has a lot of luminance frequencies as compared with that of a conventional refresh type, the lifetime problem of a DC type PDP is more serious. Even though a clear picture is realized, all is in vain unless the lifetime problem is solved.

Meanwhile, having such a superior cathode material as MgO, the AC type memory is advantageous with respect to its lifetime. Also, in 1991, Fujitsu exhibited a 33-inch, three-electrode and surface-discharge-type PDP at a Japanese electronic show, which was advantageous in realizing a wall TV as compared with the DC type memory PDP. However, the current three-electrode, and surface-discharge-type AC PDP has a complicated driving circuit, and performs scanning and sustaining with one driving circuit which could be destroyed by heat, so that an improved driving method is required. That is, a conventional surface-discharge-type PDP performs scanning and sustaining with one electrode and a single circuit, so that malfunction can occur due to coupling, and its associated circuitry is expensive.

SUMMARY OF THE INVENTION

The object of the present invention is to provide a structure of a PDP and the driving method thereof which can prevent malfunction and increase reliability by completely separating the scanning and sustaining electrodes.

To achieve the above object, the structure of a PDP of the present invention is constituted in such a manner that a plurality of anodes are formed on an upper face plate, a plurality of first sustaining electrodes are formed on a lower rear plate, a dielectric is coated on the first sustaining electrodes, a plurality of cathodes are formed on the first sustaining electrodes, a plurality of second sustaining electrodes are formed alternately and in parallel with the cathodes, and a dielectric is coated on the cathodes and second sustaining electrodes.

Also, there is provided a method for driving a PDP including a plurality of anodes formed on an upper plate, a plurality of first sustaining electrodes and a plurality of alternating second sustaining electrodes and cathodes formed on a lower plate, and a dielectric coated on the first and second sustaining electrodes and cathodes, the method comprising the steps of:

initiating a discharge by supplying a potential higher than the discharge firing voltage to the anodes and cathodes;

generating a predetermined potential between the cathodes and first sustaining electrodes to increase the voltage generated from the discharge-initiating step;

supplying a voltage higher than a discharge sustaining voltage between the first and second sustaining electrodes to maintain the discharge; and supplying a narrow pulse to the cathodes for erasing the discharge.

BRIEF DESCRIPTION OF THE DRAWINGS

Further features and advantages will become more apparent from the following and more particular description of the preferred embodiment of the invention as illustrated in the accompanying drawings in which the same reference characters generally refer to like parts throughout the views, and in which:

FIGS. 3A, 3B, and 3C show the structure of PDPs according to other embodiments of the present invention.

FIG. 4A shows a sustaining pulse waveform of the first embodiment supplied to the sustaining electrode of a PDP according to the present invention;

FIG. 4B shows a sustaining pulse waveform of the second embodiment supplied to the sustaining electrode of a PDP according to the present invention;

FIG. 4C shows a sustaining pulse waveform of the third embodiment of a PDP according to the present invention;

FIG. 4D shows a pulse waveforms supplied to the anode and cathode of a PDP according to the present invention;

FIGS. 5A to 5C show waveforms of driving pulses supplied to the PDP according to a preferred embodiment of the present invention.

DETAILED DESCRIPTION OF THE INVENTION

Figure 1:
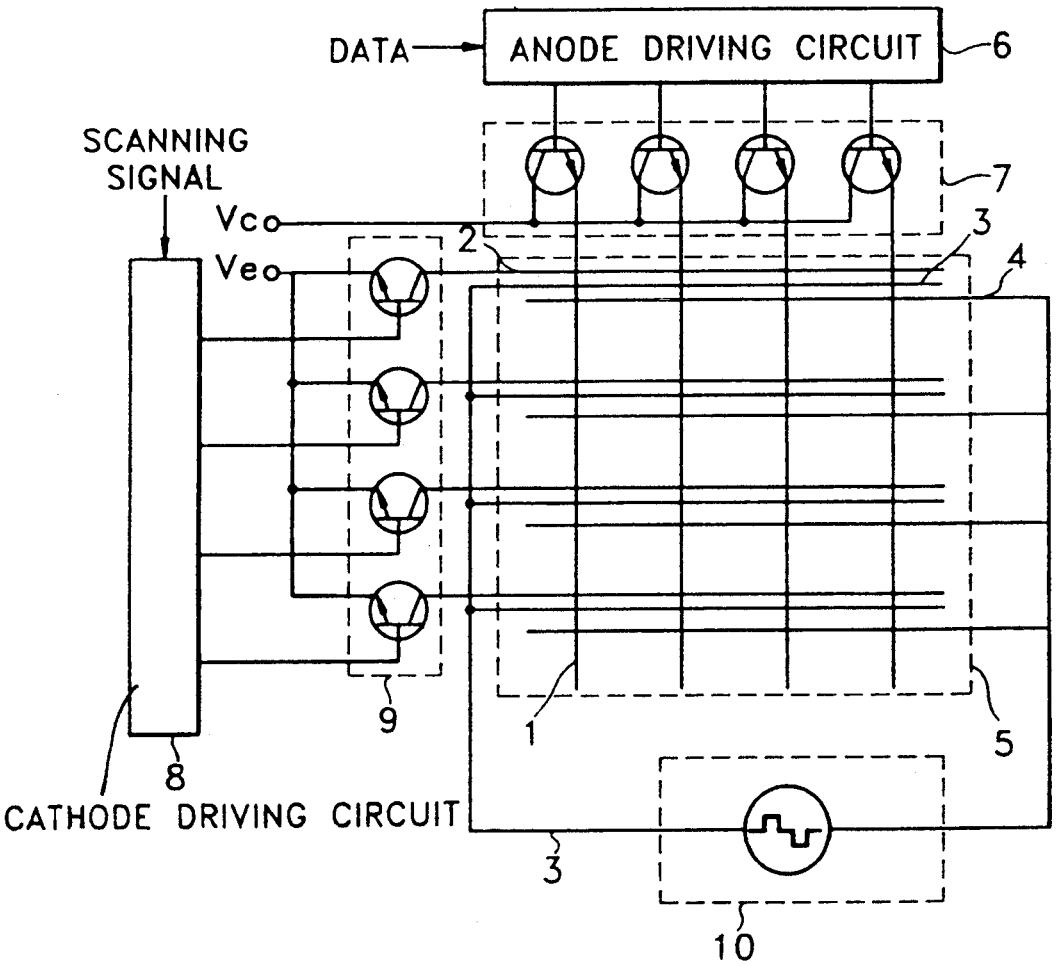
FIG. 1 is for explaining a driving circuit of a PDP according to the present invention.

FIG. 1 is for explaining a driving circuit of a PDP according to the present invention.

Referring to FIG. 1, there is provided a PDP 5 constituted by a plurality of anodes 1, a plurality of cathodes 2 orthogonal to anodes 1, a plurality of first sustaining electrodes 3 arranged in parallel with cathodes 2 and a plurality of second sustaining electrodes 4, an anode driving circuit 6 for driving anode 1 of PDP 5, switching transistors 7 each having bases receiving respective outputs of anode driving circuit 6, emitters connected to respective anodes 1 and collectors commonly connected to a predetermined voltage source Vc, a cathode driving circuit 8 for driving cathodes 2, switching transistors 9 each having bases respectively receiving outputs of cathode driving circuit 8, emitters commonly connected to a predetermined voltage source Ve and collectors respectively connected to cathodes 2, and a sustaining pulse supplying circuit 10 for supplying a predetermined pulse to the first and second sustaining electrodes. Both sustaining electrodes are completely separated from both anodes and cathodes.

FIG. 2 shows the structure of a PDP according to one embodiment of the present invention.

Figure 2A:
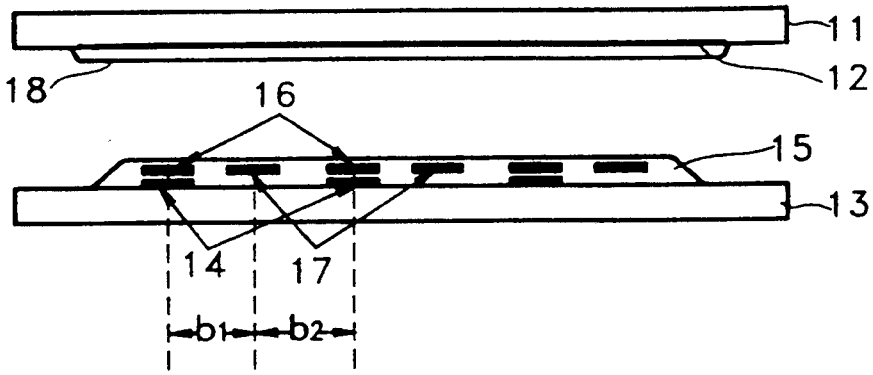
FIGS. 2A and 2B show the structure of a PDP according to one embodiment of the present invention.

Referring to FIG. 2A, anodes 12 and a fluorescent layer 18 are formed on upper face glass 11, first sustaining electrodes 14 are formed on a lower rear glass 13, a dielectric 15 is coated thereon, cathodes 16 are formed on dielectric 15, second sustaining electrodes 17 are formed alternately and in parallel with cathodes 16, and dielectric 15 is coated on second sustaining electrodes 17 and cathodes 16.

Here, second sustaining electrodes 17 can be arranged on the same plane with first sustaining electrodes 14. Also, there is no difference whether the barrier ribs are formed on the upper plate or on the lower plate.

Figure 2B:
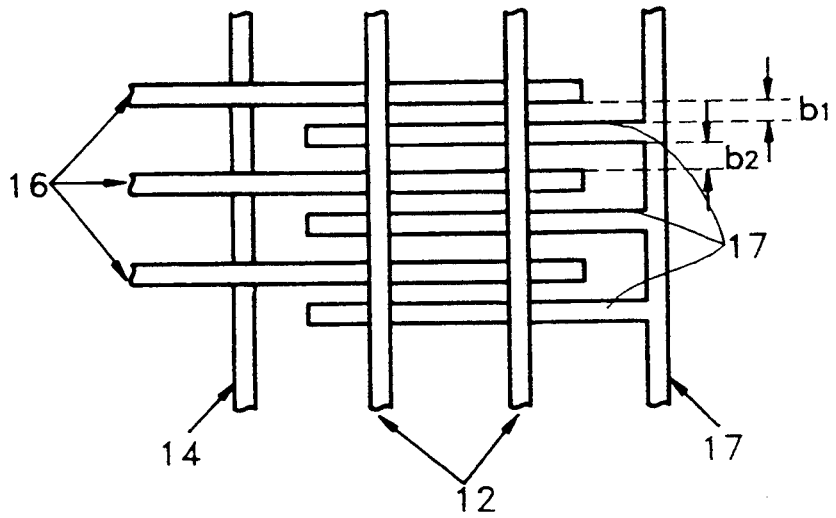

FIG. 2B shows the electrode arrangement in the structure illustrated in FIG. 2A.

Referring to FIG. 2B, cathode 16 and second sustaining electrode 17 are alternately arranged in parallel with first sustaining electrode 14 in turns, and an anode 12 is placed thereon.

As shown in FIGS. 2A and 2B, for the operation, the distance b1 between a cathode (or first sustaining electrode) and a second sustaining electrode is shorter than the distance b2 between the second sustaining electrode and the next cathode (or the next first sustaining electrode), because a discharge should occur between one cathode and second sustaining electrode. Therefore, when the distances between cathodes and second sustaining electrodes are all constant, a discharge could occur between a second sustaining electrode and the cathode of the next cell, so that the discharge does not properly occur on the selected discharge cell. That is, crosstalk could occur.

FIG. 3 shows the structure of a PDP according to another embodiment of the present invention.

Figure 3A:
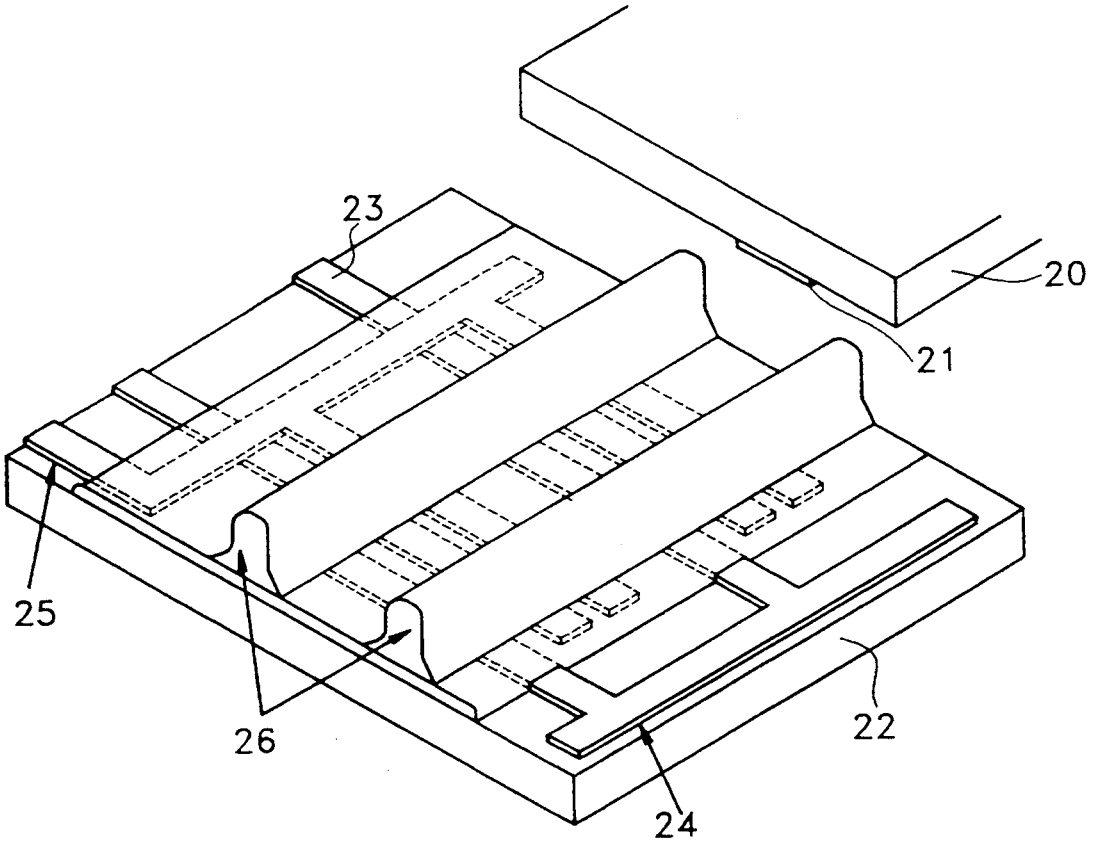

Referring to FIG. 3A, an anode 21 is formed on upper face glass 20, a cathode 23 and a second sustaining electrode 24 arranged alternately and in parallel with cathode 23 are formed on a lower rear glass 22, and a first sustaining electrode 25 and a barrier rib 26 are formed on cathode 23 and second sustaining electrode 24.

FIG. 3B shows the arrangement of electrodes in the structure illustrated in FIG. 3A.

Referring to FIG. 3B, cathodes 23 are arranged in parallel with one another, first sustaining electrodes 25 are arranged alternately and in parallel with cathodes 23, second sustaining electrodes 24 are arranged alternately and in parallel between cathodes 23 and first sustaining electrodes 25, and anodes 21 are crossed with cathodes 23. For the actual operation, distance d1 between first sustaining electrodes 25 and cathodes 23 should be further narrower than distance d2 between the cathodes and second sustaining electrodes 24. Therefore, the capacitance between first sustaining electrodes 25 and cathodes 23 is increased to improve coupling.

Figure 3C:
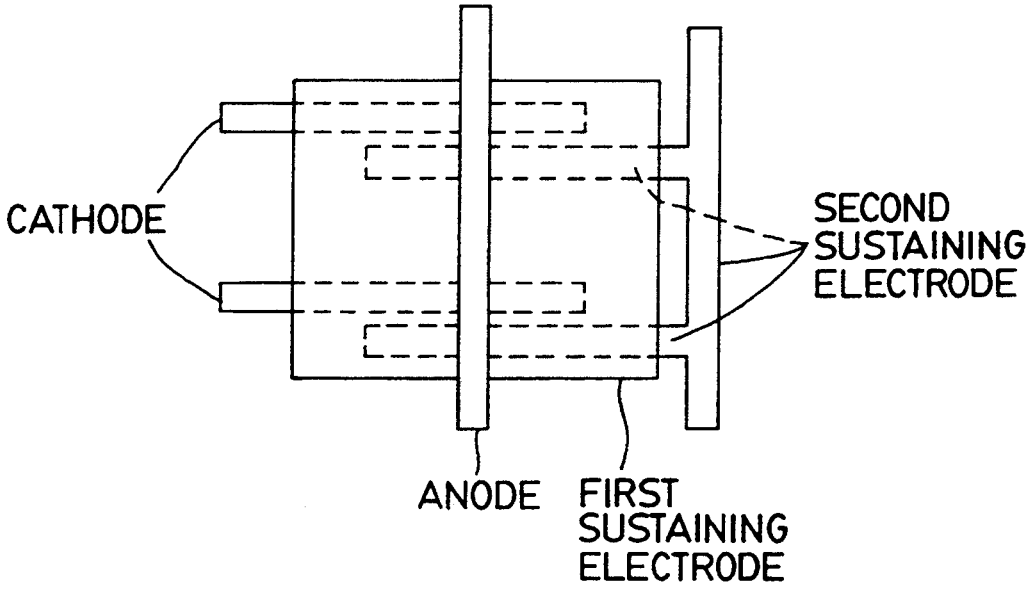

The PDP may have cathodes and anodes disposed parallel to each other or crossing each other. The first and second sustaining electrodes are disposed either parallel to or crossing each other in either the column or row direction. Alternatively, the first sustaining electrodes cover the whole surface, and the second sustaining electrodes are arranged in the column or row direction as shown in FIG. 3C.

FIG. 4A shows a method for driving a PDP of an embodiment according to the present invention.

Referring to FIG. 4A, a pulse supplied to the first sustaining electrode has a period Ts, which is 0 V during terms I and II, +V during term III, and 0 V during terms IV and V. A pulse supplied to the second sustaining electrode has a period Ts, which is 0 V during terms I, II and III, +V during term IV, and 0 V during term V.

FIG. 4B shows a method for driving a PDP of the second embodiment according to the present invention.

Referring to FIG. 4B, a pulse supplied to the first sustaining electrode has a period Ts, which is 0 V during terms I and II, +V/2 during term III, −V/2 during term IV, and 0 V during term V. A pulse supplied to the second sustaining electrode has a period Ts, which is 0 V during terms I and II, −V/2 during term III, +V/2 during term IV, and 0 V during term V.

FIG. 4C shows a method for driving a PDP of the third embodiment according to the present invention.

Referring to FIG. 4C, a pulse supplied to the first sustaining electrode has a period Ts, which is 0 V during terms I and li, +V during term III, −V during term IV, 0 V during term V. A pulse supplied to the second electrode is 0 V during terms I through IV.

FIG. 4D shows waveforms supplied to the anode and cathode of a PDP according to the present invention.

FIGS. 5A to 5C show a driving pulse of a PDP according to a preferred embodiment of the present invention.

Referring to FIG. 5A, a pulse supplied to the first sustaining electrode has a period Ts, which is 0 V during term I, −V/4 during term II, V during term III, and 0 V during terms IV and V. A pulse supplied to the second sustaining electrode has a period Ts, which is 0 V during terms I, II, III and IV, and V during term V.

Referring to FIG. 5B, a negative pulse is supplied to the cathode during terms I and II for scanning.

If there is a data writing, a positive pulse is supplied to the anode during term I. The difference of the voltage of a pulse supplied to the cathode and anode should be higher than the discharge firing voltage.

In order to erase the written data, a narrow pulse is supplied to the cathode to be erased during term IV of the next period.

For example, the potential of the pulses is set in such a manner that a discharge firing voltage is higher than 220 V, and the sustaining voltage is higher than 180 V.

Referring to FIG. 5C, term I is for charging the dielectric formed between the cathode and first sustaining electrode, and term II is for discharging between the cathode and the first sustaining electrode. That is because the charges of the first sustaining electrode cannot be transmitted to positive charges efficiently, if the potential of the first sustaining electrode is reduced without discharging.

FIGS. 6A to 6E is for explaining the operation of PDP when the pulse of FIG. 4B is applied to PDP.

Figure 6A:
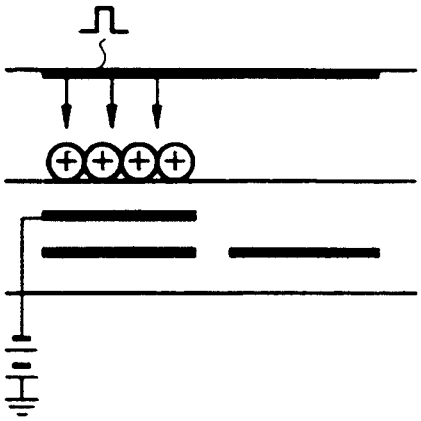
FIGS. 6A to 6E show the operation of a PDP according to the present invention.

FIG. 6A is for explaining the writing operation. When a negative pulse is supplied to the cathode and a positive pulse is supplied to the anode (corresponding to period 1 shown in FIG. 4D), the difference between potentials of the cathode and anode exceeds the discharge firing voltage, so that the discharge is initiated. That is, the positive charge generated while discharging is accumulated on the surface of a dielectric on the cathode.

Figure 6B:
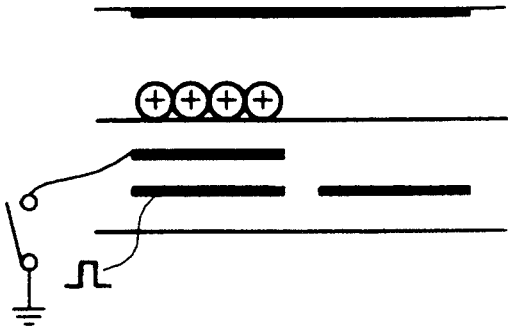

FIG. 6B shows the increase of the wall voltage. After the scanning is over (corresponding to period II shown in FIG. 4D), in the wall voltage generated by the accumulation of the positive charge, the scanning electrode is floating, and the potential of the sustaining electrode increases, so that the potential of a dielectric layer is more increased by adding the sustaining voltage to the wall voltage. That is, the charge is accumulated on the capacitor, and floated. Then, 100 V is supplied to its one terminal of the capacitor, so that the potential of its other terminal is increased to 100 V plus the charging voltage of the capacitor.

Figure 6C:
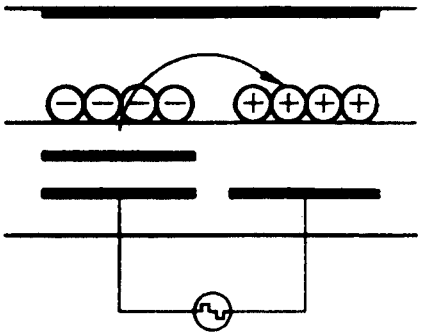

FIG. 6C is for explaining the sustaining of discharge. If a positive voltage is supplied to sustaining electrode S1 and a negative voltage is supplied to sustaining electrode S2 (corresponding to period III shown in FIG. 4D), the positive charge accumulated on the dielectric layer on the cathode is moved to the dielectric layer on sustaining electrode S2, and electron is accumulated on the dielectric layer on sustaining electrode S1 to create sustaining discharge.

Figure 6D:
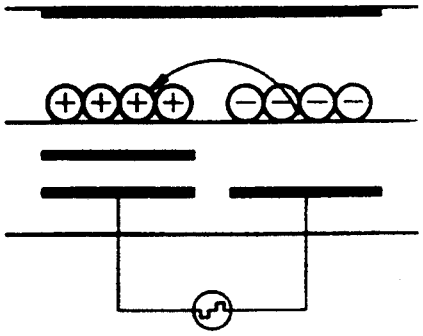

FIG. 6D is for explaining a sustaining discharge. When a negative voltage is supplied to sustaining electrode S1 and a positive voltage is supplied to sustaining electrode S2 (corresponding to period IV shown in FIG. 4D), electrons are accumulated on the dielectric layer on sustaining electrode S2 and positive charges are accumulated on the dielectric layer on sustaining electrode S1 to create sustaining discharge.

Figure 6E:
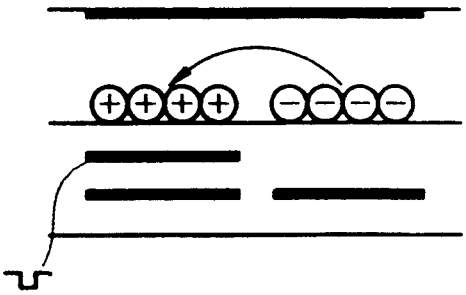

FIG. 6E is for explaining an erasing operation. When a negative pulse is supplied to the cathode for a short time, a short discharge occurs between the cathode and sustaining electrode S2, so that the wall charge is erased (corresponding to period V shown in FIG. 4D).

Accordingly, the sustaining electrode is completely separated from other electrodes employing a PDP of the present invention and a driving method thereof, so that a stable memory operation is realized. Although utilizing AC-type writing the entire operation except for the sustaining is identical with that of the current DC types. This means that the writing and scanning circuitry is simple so that the cost can be lowered. The PDP according to the present invention employs the same, simple manufacturing method of the conventional DC type PDP.

Particularly, as compared with a conventional three-electrode type PDP in which the driving circuit for scanning carries out sustaining as well as scanning, the present invention completely separates the sustaining operation, so that its driving circuit is not destroyed by heat and can be constituted by a general IC. Since sustaining is separately driven by combining the whole electrode into one, the expensive IC of the conventional AC type is unnecessary, and is possibly constituted only by two transistors.

What is claimed is:

1. A plasma display panel (PDP) comprising:
a first plate;
a plurality of anodes disposed on the first plate;
a second plate;
a plurality of first sustaining electrodes disposed on the second plate;
a first portion of a dielectric layer disposed on and covering the plurality of first sustaining electrodes;
a plurality of cathodes disposed on the first portion of the dielectric layer, each cathode covering and opposing a corresponding first sustaining electrode;
a plurality of second sustaining electrodes disposed on the second plate; and
a second portion of the dielectric layer disposed on the second sustaining electrodes and the cathodes, one of the cathodes being disposed adjacent one of the anodes for initiating a discharge at a selected discharge cell wherein at least one of the first sustaining electrodes and at least one of the second sustaining electrodes are disposed proximate the selected discharge cell for sustaining the discharge.

2. The PDP as claimed in claim 1 wherein the first and second sustaining electrodes are parallel and are arranged alternatingly and in the same plane.

3. The PDP as claimed in claim 1 wherein the anodes and cathodes are arranged in a matrix form.

4. The PDP as claimed in claim 1, wherein the first sustaining electrodes are connected to a common terminal.

5. The PDP as claimed in claim 1 wherein the second sustaining electrodes are connected to a common terminal.

6. The PDP as claimed in claim 1 wherein the plurality of first and second sustaining electrodes are parallel to the plurality of cathodes.

7. The PDP as claimed in claim 1 wherein the plurality of first sustaining electrodes are stripes, the stripes being parallel to the plurality of cathodes.

8. A plasma display panel comprising:
a first plate;
a plurality of anodes disposed on the first plate;
a second plate;
a plurality of first sustaining electrodes disposed on the second plate;
a first portion of a dielectric layer disposed on and covering the first sustaining electrodes;
a plurality of second sustaining electrodes disposed on the second plate;
a plurality of cathodes disposed on the second plate on the first portion of the dielectric layer, each cathode opposing and covering a corresponding first sustaining electrode; and
a second portion of the dielectric layer disposed on the first and second sustaining electrodes and the cathodes wherein the first and second sustaining electrodes are parallel and alternatingly arranged.

9. A plasma display panel comprising:
a first plate;
a plurality of anodes disposed on the first plate;
a second plate;
a plurality of first sustaining electrodes disposed on the second plate;
a first portion of a dielectric layer disposed on the first sustaining electrodes;
a plurality of second sustaining electrodes disposed on the second plate;
a plurality of cathodes disposed on the second plate on the first portion of the dielectric layer, each cathode opposing and covering a corresponding first sustaining electrode; and
a second portion of the dielectric layer disposed on the pluralities of first and second sustaining electrodes and cathodes wherein the second sustaining electrodes are parallel to and alternate with the cathodes.

10. A plasma display panel comprising:
a first plate;
a plurality of anodes disposed on the first plate;
a second plate;
a first sustaining electrode disposed on and entirely covering a surface of the second plate;
a first portion of a dielectric layer disposed on and covering the first sustaining electrode;
a plurality of second sustaining electrodes disposed on the second plate on the first portion of the dielectric layer;

a plurality of cathodes disposed on the portion of the first dielectric layer opposing and covering the first sustaining electrode; and a second portion of the dielectric layer disposed on the plurality of second sustaining electrodes and the plurality of cathodes wherein the second sustaining electrodes are stripes disposed parallel to the anodes.

11. A method for driving a plasma display panel including an anode formed on an upper plate, a plurality of first sustaining electrodes and a plurality of second sustaining electrodes and cathodes formed on a lower plate, and a dielectric coated on said first and second sustaining electrodes and said cathode, said method including the steps of:

initiating a discharge by supplying a potential higher than the discharge firing voltage to said anode and cathode;

generating a predetermined potential between said cathode and first sustaining electrode to increase the voltage generated from said discharge-initiating step;

supplying a voltage higher than a discharge sustaining voltage between said first and second sustaining electrodes to maintain the discharge; and supplying a narrow pulse to said cathode for erasing said discharge.

12. A plasma display panel comprising:

first and second plates;

a plurality of anodes disposed on the first plate;

a plurality of first sustaining electrodes disposed on the second plate;

a dielectric disposed on and covering the plurality of first sustaining electrodes;

a plurality of second sustaining electrodes disposed on the second plate; and a plurality of cathodes disposed on the dielectric, each cathode opposing and covering a corresponding first sustaining electrode wherein the first and second sustaining electrodes are alternatingly arranged parallel to respective cathodes, each second sustaining electrode for maintaining a discharge initiated at an adjacent cathode and spaced a distance b2 from the adjacent cathode, each first sustaining electrode for maintaining the discharge initiated at the adjacent cathode and spaced a distance b1 from the adjacent cathode, the distance b2 being greater than the distance b1.

13. The plasma display panel as claimed in claim 12 wherein one of the cathodes is disposed adjacent one of the anodes for initiating a discharge at a selected discharge cell therebetween, one of the first sustaining electrodes is disposed at the distance b1 from the selected discharge cell for sustaining the discharge, and one of the second sustaining electrodes is disposed at the distance b2 from the selected discharge cell for sustaining the discharge.

* * * * *